US006484762B2

(12) United States Patent
Fehland et al.

(10) Patent No.: US 6,484,762 B2
(45) Date of Patent: Nov. 26, 2002

(54) FILLING SYSTEM WITH POST-DRIPPING PREVENTION

(75) Inventors: Jörn Richard Fehland, Hamburg (DE); Jens H. Pöpplau, Hamburg (DE)

(73) Assignee: Alfill Engineering GmbH & Co. KG, Hamburg (DE)

( * ) Notice: Subject to any disclaimer, the term of this patent is extended or adjusted under 35 U.S.C. 154(b) by 0 days.

(21) Appl. No.: 09/948,072

(22) Filed: Sep. 6, 2001

(65) Prior Publication Data

US 2002/0046781 A1 Apr. 25, 2002

(30) Foreign Application Priority Data

Sep. 7, 2000 (DE) ..... 100 44 307

(51) Int. Cl.[7] ..... B65B 1/04
(52) U.S. Cl. ..... 141/86; 141/311 A; 141/301
(58) Field of Search ..... 141/85, 86, 89, 141/93, 311 A, 115, 116, 117, 119, 126, 72, 39, 301, 302

(56) References Cited

U.S. PATENT DOCUMENTS

| | | | | | |
|---|---|---|---|---|---|
| 4,096,894 | A | * | 6/1978 | Guy | 141/93 |
| 4,347,875 | A | * | 9/1982 | Columbus | 141/18 |
| 4,530,384 | A | * | 7/1985 | Boyes | 138/103 |
| 5,094,278 | A | * | 3/1992 | Arao et al. | 141/116 |
| 5,474,113 | A | * | 12/1995 | Rademacher et al. | 141/116 |

* cited by examiner

*Primary Examiner*—Steven O. Douglas
(74) *Attorney, Agent, or Firm*—Rankin, Hill, Porter & Clark LLP

(57) ABSTRACT

A filling system that fills beverages into containers and includes a valve for controlling the feed of filling material and mounted a distance above the discharge aperture to define a discharge surface between the valve and the discharge aperture. The filling system also includes a post-dripping precluding device preventing post-dripping of the filling material when the valve is closed. The post-dripping precluding device enhances the drop detachment of the filling material from the discharge surface of the discharge zone.

13 Claims, 1 Drawing Sheet

FILLING SYSTEM WITH POST-DRIPPING PREVENTION

BACKGROUND OF THE INVENTION

Filling systems are used in filling machines to fill beverage containers such as bottles or cans with beverages such as mineral water, fruit juice or beer. To control the filling procedure, such filling systems are fitted with valves mounted in the supply path of the filling material.

It is known as regards the case of the above filling control valve being designed other than a foot valve, that drops of filling material will remain at the walls on the valve discharge side and will drip once the valve has been closed. This dripping arises some time after closing the valve, and as a result dripping may even take place when a beverage container is no longer situated below the filler system's discharge aperture. This dripping may, on one hand, result in filling inaccuracies. On the other hand, the falling drops will either reach the filling machine floor, or they will soil the filling machine below the filling system. Especially as regards high-calorie beverages, the dripping material provides a nutrient substrate jeopardizing the sterility of the filling procedure. Consequently, frequent cycles of cleaning must be carried out to meet the filling sterility requirements. In general, however, cleaning entails interrupting filling and thus interferes with economical operation of the filling machine.

The state of the art counters the above post-dripping problem by fitting the filling system with devices preventing any remnant drops from falling. Illustratively, the discharge aperture of the filling system is fitted with a sieve. However, such sieves negatively affect the flow of the filling material because they entail undesired eddies that, in turn, may produce foaming of the filling material inside the container. When filling fruit juices, which are especially likely to contain fruit fibers, the use of a sieve is precluded anyway because it would quickly clog.

Another drawback of the known post-drip prevention devices is that the drops may fall despite the use of such devices. While the post-dripping problem is being palliated, namely fewer drops shall contribute to soiling the filling machine, the intrinsic problem on the other hand remains unsolved.

SUMMARY OF THE INVENTION

Therefore an objective of the present invention is to create a filling system overcoming the above post-dripping problems.

The basic concept of the invention is not to interfere with the dripping of drops that form on the discharge surface but rather to enhance or to force this dripping of the filling material from the discharge surface. Accordingly, the filling system of the invention includes a post-dripping precluding device that enhances early-dripping of the filling material. The discharge surface shall be understood to be at least the filling system's inside wall zone running at the discharge side of the filling-material control valve as far as the discharge aperture.

According to the present invention, the post-dripping precluding device assures that after the filling-material control valve moves into its closed position, any drops present will fall at once and, hence, shall reach the beverage container that is still situated below the discharge aperture. All drops will have fallen before the beverage container is removed and, as a result, the filling machine will not be soiled on account of time-delayed dripping.

In further accordance with the present invention, the post-dripping precluding device advantageously assumes the form of a hydrophobic discharge surface of at least the discharge zone on the valve's discharge side. Because the discharge surface of the invention is hydrophobic, drops are unable to adhere to the discharge surface and instead immediately detach off it as soon as the valve shuts off the supply of filling material. The term "hydrophobic" is to be construed broadly as denoting that the filling material is repelled by the surface.

In further accordance with the present invention, the discharge surface is preferably made of polytetrafluoroethylene (hereinafter PTFE), which is commonly sold under the trademark TEFLON by E. I. Du Pont de Nemours and Company. PTFE exhibits the desired hydrophobia and, moreover, is economical, unobjectionable with respect to foodstuffs, and also is easily machined. It is also stable still at the temperatures of hot filling and it is insensitive to common cleansing means.

The surface of the discharge zone may be made of PTFE, or a portion of the filling system may be a thick, hollowed body made of PTFE of which the inside surface shall constitute the discharge surface. However, the entire filling system may also consist of PTFE.

The present invention also concerns an alternative to this hydrophobic surface wherein the post-dripping precluding device is a micro-structured discharge surface causing a lotus effect. It is known that appropriate microstructured surfaces will reduce the contact area with liquid drops. Accordingly, this alternative also reduces the adhesion of the filling material to the discharge surface and the filling material will immediately drip off. In this manner there will be effective suppression of time-delayed dripping. All wall zones of the filling system that are in contact with the filling material may be microstructured surfaces in this design as well.

A further advantageous alternative of the post-dripping precluding device is designed to induce vibrations in the filling system's discharge surface. It is well known that the drops on a surface that is both slanted and vibrating will rapidly drop off it. When the surface is made to vibrate, time-delayed dripping will therefore be precluded.

Advantageously and in accordance with another aspect of the invention, the post-dripping precluding device is in the form of mechanical means impacting the filling system. Such means, for instance in the form of a displaceable lever, can be initiated in a synchronized manner, such as by the closing of the valve. As regards rotary filling machines, however, the impacting means also may be a stationary component with which the rotary filling system will periodically collide during rotation.

Alternatively, the post-dripping precluding device applies acoustic waves to at least the filling system's discharge zone. Therefore, an appropriate sound source must be mounted with acoustic access to the filling system's discharge zone. The acoustic source may be operated as needed continuously or be timed into operation upon valve closure.

In accordance with a further advantageous alternative, the post-dripping precluding device is in the form of a piezoelectric surface driven into vibrations of voltage-controlled amplitude and frequency. The voltage must, therefore, be appropriately selected. Again, in this embodiment only the surface need be piezoelectric, or else a solid portion of the filling system of which the inside surface shall constitute the discharge surface.

In further accordance with the present invention, the post-dripping precluding device is designed such that an expelling gas may be forced onto the discharge surface. For that purpose the filling system illustratively is fitted with an annular gas-expelling aperture directly underneath the valve seat. The aperture transmits the expelled air into the discharge zone and onto the discharge surface. Any generated drops will be blown away by the expelled air.

Another feature of the invention provides a perforation in the discharge surface and directs a blow-off gas through the perforations into the discharge zone. The discharge surface may advantageously consist of a porous sintered material.

BRIEF DESCRIPTION OF THE DRAWINGS

These and further details and features of the invention are stated in the description below elucidating illustrative embodiments in relation to the attached drawings.

DETAILED DESCRIPTION OF THE PREFERRED EMBODIMENTS

Figure 1:
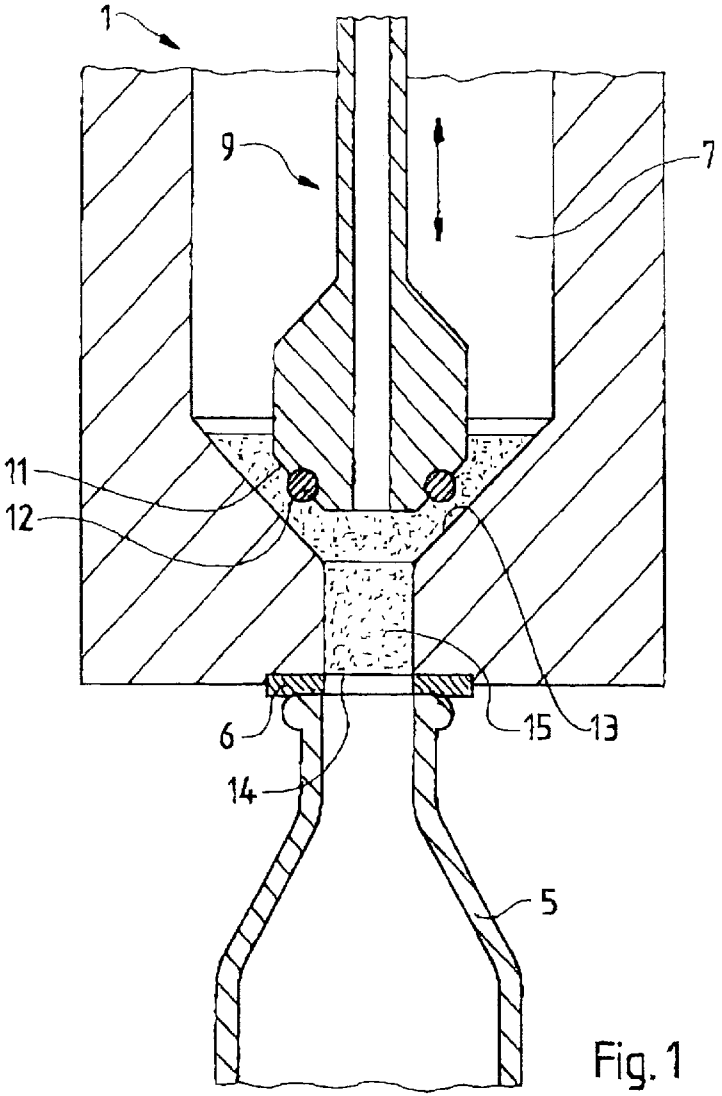
FIG. 1 shows a section of a filling system of the invention fitted with a post-dripping precluding device; and, FIG. 2 is a section of a second filling system of the invention.

FIG. 1 shows a filling system 1 communicating through a filling-material feed (not shown) and a return gas duct (not shown) with the supply container of a filling machine that may be of conventional rotary or linear design. An in-line meter at the filling material feed may detect the flow through it. The quantity of filling material having entered a container 5, in this instance a bottle, may be determined by integration over time and be used to control the filling procedure. The container 5 is affixed during filling by retaining means (not shown) acting on the container base so as to be sealed against a container seal 6 at the filling system 1.

Figure 2:
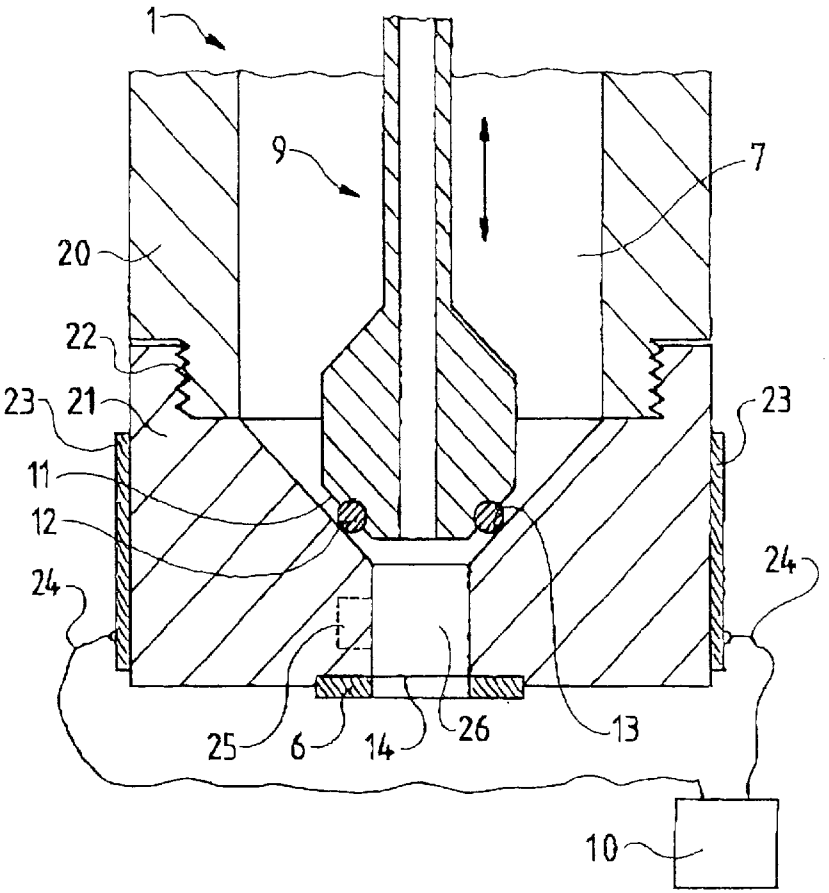

The filling-material feed issuing into the container 5 in this embodiment is controlled by a valve 9, which is displaceable in height and is supported in pressure-proof sealed manner. The pressure-tight sealing during permissible height-displacement is typically implemented by a sliding seal. When the valve 9 has been fully lowered, the annular seal 12 mounted on the undercut 11 of the valve comes to rest against an associated annular wall segment of the filling chamber 7 constituting the valve seat 13. FIG. 2 shows the valve 9 in its lowered, i.e. sealing/closed state.

The wall segment of the filling chamber 7 running from the discharge aperture 14 as far up above the valve seat 13 is fitted with illustratively a hydrophobic PTFE layer 15 . Filling material adheres only very poorly to this surface.

Moreover, the entire chamber wall may be made hydrophobic instead of merely the lower wall segment of the filling material chamber 7 being fitted with a hydrophobic layer 15. Such an extension of hydrophobia would be advantageously for instance as regards cleaning, because both the filling material and the cleaning substances would then be hampered in their adhesion. FIG. 2 shows a second filling system 1 of the invention consisting of an upper segment 20 and a lower segment 21 that are connected in this instance by screw threads 22. As an alternative, the upper and lower segments may be permanently connected by bonding or the like.

The lower segment 21 of the filling system 1 is made of a piezoelectric material to which a voltage is applied by conducting plates 23 mounted sideways to the filling system 1 and connected through conductors 24 to the two terminals of a voltage source 10. When a voltage is present, the lower segment 21 of the filling system 1 is made to vibrate as a function of the frequency and amplitude of the drive voltage. The vibration of the lower segment 21 must be taken into account when selecting the connection to the upper segment 20.

Moreover, the entire filling system 1 may be made of a piezoelectric material, in which case there is no need to appropriately connect two segments. As an alternative to this integral design, only one piezoelectric layer might be needed for the lower wall zone or the entire wall zone of the filling material chamber 7, in the manner discussed above in relation to a hydrophobic layer 15 in FIG. 1. In such a design the voltage-applying conducting plates then would be mounted underneath the layer and a multi-layer structure would ensue.

An acoustic source 25 is shown in dashed lines in FIG. 2 and has access to the discharge zone 26 for the purpose of unimpeded acoustic output, being able to load this zone 26 with acoustic waves. Both the power supply to the acoustic source 25 and its feed lines are omitted for the sake of clarity.

Moreover, a second or an arbitrary number of acoustic sources 25 may be used, or several of the above steps preventing post-dripping may be combined, for instance by providing one acoustic source 25 in conjunction with one hydrophobic layer 15 of at least one discharge zone 26.

The present invention has been described herein with particularity, but it is noted that the scope of the invention is not limited thereto. Rather, the present invention is considered to be possible of numerous modifications, alterations, and combinations of parts and, therefore, is only defined by the claims appended hereto.

What is claimed is:

1. A filling system to (1) fill beverages into containers (5) and comprising a valve (9) controlling a feed of filling material and mounted a distance above a discharge aperture (14) such that a discharge zone (26) including a discharge surface remains between the valve (9) and the discharge aperture (14), further comprising a post-dripping precluding device precluding post-dripping of the filling material when the valve (9) is closed, wherein said post-dripping precluding device is designed to enhance drop detachment of the filling material from the discharge surface of the discharge zone (26).

2. The filling system (1) as claimed in claim 1, wherein the post-dripping precluding device includes a hydrophobic discharge surface (15) on at least the discharge zone (26).

3. The filling system (1) as claimed in claim 2, wherein the discharge surface (15) is made of PTFE.

4. The filling system (1) as claimed in claim 1, wherein the post-dripping precluding device is designed as a microstructured discharge-surface (15) exhibiting a lotus effect.

5. The filling system (1) as claimed in claim 1, wherein the post-dripping precluding device vibrates the discharge surface (15).

6. The filling system (1) as claimed in claim 5, wherein the post-dripping precluding device includes mechanical elements impacting the filling system (1).

7. The filling system as claimed in claim 5, wherein the post-dripping precluding device applies acoustic waves to at least the discharge zone (26).

8. The filling system (1) as claimed in claim 5, wherein the post-dripping precluding device includes a piezoelectric discharge surface (15) to which a voltage is applied.

9. The filling system (1) as claimed in claim 1, wherein the post-dripping precluding device is designed such that a blowoff gas can be applied to the discharge surface (15).

10. The filling system (1) as claimed in claim 9, wherein the discharge surface (15) is fitted with a perforation through which the blowoff gas can be applied to the discharge zone (26).

11. The filling system (1) as claimed in claim 10, wherein the discharge surface (15) consists of a porous, sintered material.

12. The filling system as claimed in claim 1, wherein said discharge zone (26) defines a passageway, and wherein said discharge surface forms a sidewall of said passageway.

13. The filling system as claimed in claim 12, wherein said valve is disposed near one end of said passageway and said discharge aperture is disposed at an opposite end of said passageway.

* * * * *